US008411116B2

(12) United States Patent
Karrenbauer et al.

(10) Patent No.: US 8,411,116 B2
(45) Date of Patent: Apr. 2, 2013

(54) METHOD, SYSTEM AND APPARATUS FOR POWER SAVING BACKLIGHT

(75) Inventors: Andreas Karrenbauer, St. Wendel (DE); Marc Albrecht, San Francisco, CA (US); Chihao Xu, Saarbruecken (DE)

(73) Assignee: Chihao XU, Saarbruecken (DE)

( * ) Notice: Subject to any disclaimer, the term of this patent is extended or adjusted under 35 U.S.C. 154(b) by 577 days.

(21) Appl. No.: 12/632,435

(22) Filed: Dec. 7, 2009

(65) Prior Publication Data

US 2011/0063331 A1 Mar. 17, 2011

Related U.S. Application Data

(63) Continuation-in-part of application No. 12/557,585, filed on Sep. 11, 2009.

(51) Int. Cl.
*G09G 5/10* (2006.01)
*G09G 3/36* (2006.01)

(52) U.S. Cl. ..... 345/690; 345/102

(58) Field of Classification Search ..... None
See application file for complete search history.

(56) References Cited

U.S. PATENT DOCUMENTS

| | | | | |
|---|---|---|---|---|
| 2005/0073495 | A1* | 4/2005 | Harbers et al. | 345/102 |
| 2006/0209005 | A1* | 9/2006 | Pedram et al. | 345/102 |
| 2007/0046829 | A1* | 3/2007 | Su et al. | 348/678 |
| 2007/0262947 | A1* | 11/2007 | Wang et al. | 345/102 |
| 2009/0109165 | A1* | 4/2009 | Park et al. | 345/102 |
| 2010/0302133 | A1* | 12/2010 | Liang et al. | 345/102 |

* cited by examiner

*Primary Examiner* — Joseph Haley
*Assistant Examiner* — Nicholas Lee
(74) *Attorney, Agent, or Firm* — Maier & Maier PLLC

(57) ABSTRACT

A method and system for displaying an image on a liquid crystal display (LCD) that may reduce power consumption. The method and system can include calculating a luminance for pixels in an image in a LCD based upon a light spread function and brightness values of light emitting diodes (LEDs). The method and system can also include changing a brightness of an LED based upon a consideration of the gray value of the pixels and the distance of the pixels from a dominant LED. The method and system can further set the brightness of the LED units to a brightness or brightness value substantially greater than or equal to a gray value of each pixel of the image.

23 Claims, 8 Drawing Sheets

METHOD, SYSTEM AND APPARATUS FOR POWER SAVING BACKLIGHT

RELATED APPLICATIONS

The present invention is a continuation-in-part and claims priority under 35 U.S.C. §120 to U.S. patent application Ser. No. 12/557,585, filed on Sep. 11, 2009, the disclosure of which is incorporated by reference herein in its entirety.

BACKGROUND

Displays and display technology are used for a variety purposes. For example, displays are used for traditional uses such as watching television or in conjunction with a computer for viewing and manipulating data. Additionally, display technology has been implemented in a variety of mobile components, such as mobile telephones, that are increasingly used for both communication and as a multi-media tool.

A common type of display used in a variety of applications is a liquid crystal display (LCD). LCDs are typically thin, flat panels that may be manufactured to fit a variety of size and space parameters and whose common specifications and components are known. Power consumption for LCDs is, however, a concern as LCDs are both being used in more mobile, battery powered devices as well as being formed for larger displays. The backlight used for the LCD is often the component of the LCD with the highest power consumption. Light emitting diode (LED) backlights are one type of backlight that currently allows for the most optimal display and definition when using an LCD.

Additionally, red-green-blue (RGB) LEDs and/or white LEDs may be used in an LCD to generate a high number of colors. Further, the red, green and blue (RGB) LEDs, white LEDs or any other combination of LEDs can be arranged in a specified structure (e.g. grid structure) behind or beside a pixel plane of the LCD and may be driven by pulse width modulation (PWM) in a process known as local dimming, as desired by the properties of the image that is being displayed.

In order to achieve a properly displayed image at a lower power consumption, the brightness of the LEDs must be accurately calculated. The brightness of the LEDs can be referred to as PWM values and, based upon these values, an image can be displayed with varying color and contrast. However, some current methods of calculating PWM values rely on a series of approximation algorithms for image processing. These algorithms use filter functions and a variety of complex mathematical operations and iterations to find approximate solutions to downsize a high resolution source image in order to determine values of a low resolution LED grid. The approximate solutions for the PWM values, however, result in the LED backlight using more power than necessary and can cause flaws in an image to be displayed on the LCD, such as lower image resolution and clipping. Additionally, the complex nature of the approximation algorithms facilitates the use of more complex, expensive hardware to perform the approximations. Further, because of the time needed to make the calculations, the process is slower which can lead to problems in displaying video content, for example the display of video at a less desirable frame rate.

SUMMARY

A method, system and apparatus for displaying an image on a liquid crystal display. The method can include, in some exemplary embodiments, steps for calculating a luminance for pixels in an image in a liquid crystal display (LCD) based upon a light spread function and brightness values of light emitting diodes (LEDs); changing a brightness value of an LED based upon a consideration of a gray value of the pixels and a distance of the pixels from a dominant LED; and setting the brightness value of the LEDs units to a brightness value substantially greater than or equal to a gray value of each pixel of the image.

In other exemplary embodiments, a liquid crystal display may be described. The liquid crystal display can include a plurality of pixels to display an image; a backlight with a plurality of light emitting diodes; and a processor that processor calculates a luminance for the plurality of pixels in an image in the liquid crystal display, changes a brightness of a light emitting diode based upon a consideration of a gray value of a number of the plurality of pixels and a distance of the number of the plurality of pixels from a dominant light emitting diode and sets the brightness of the plurality of light emitting diodes to a brightness at least equal to the gray value of the plurality of pixels in the image.

In still other exemplary embodiments, a system for providing an image on a liquid crystal display may be described. The system may include a plurality of pixels that display an image on a liquid crystal display (LCD); a backlight having a plurality of light emitting diodes that light the image; and at least one processor that calculates a luminance for pixels in an image in a LCD based upon a light spread function and brightness values of light emitting diodes (LEDs), changes a brightness of an LED based upon a consideration of the gray value of the pixels and the distance of the pixels from a dominant LED and sets the brightness of the LED units to a brightness substantially greater than or equal to a gray value of each pixel of the image.

BRIEF DESCRIPTION OF THE FIGURES

Advantages of embodiments of the present invention will be apparent from the following detailed description of the exemplary embodiments thereof, which description should be considered in conjunction with the accompanying drawings in which.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the term "embodiments of the invention" does not require that all embodiments of the invention include the discussed feature, advantage or mode of operation.

Generally referring to FIGS. 1-9, a system, method and apparatus for displaying an image on a liquid crystal display may be described. The system, method and apparatus can include the utilization of any of a variety of mathematical operations to determine desired pulse width modulation values for the light emitting diodes in a backlight of an LCD. The system, method and apparatus may allow for the display of images on an LCD that are clipping free and maintain a desired image quality while conserving energy over known display techniques.

Figure 1:
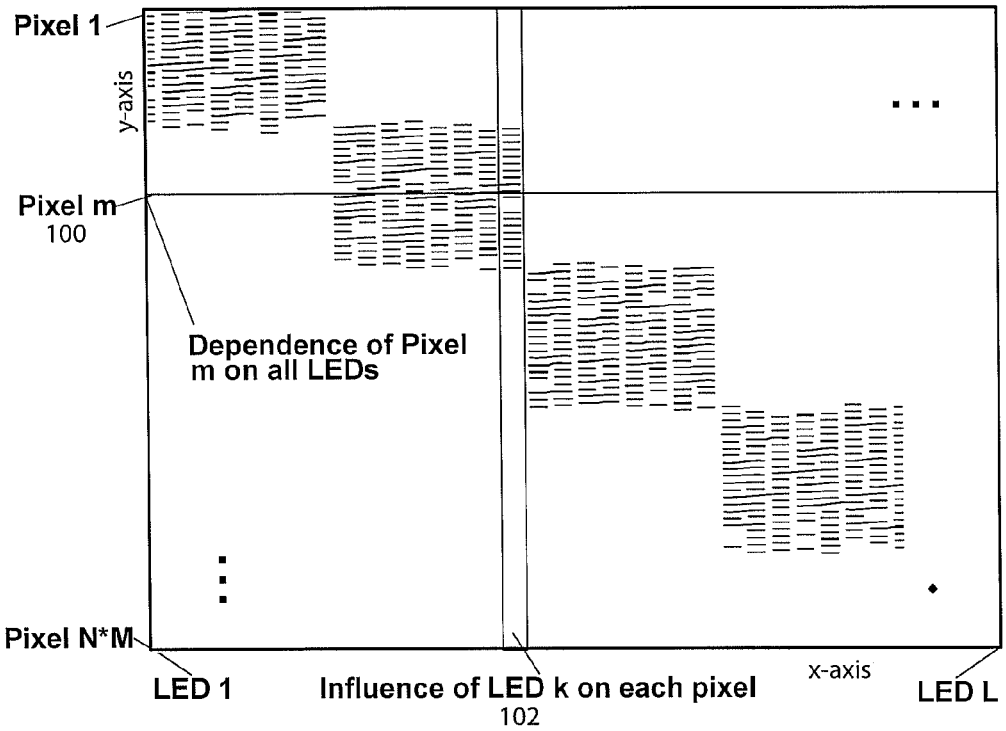
FIG. 1 is an exemplary chart showing a relationship between LEDs and pixels.

FIG. 1 is an exemplary graphical representation of a matrix (matrix A) that can represent the light spread function of the luminance of pixels in a backlight where the Y-axis can show a pixel (for example pixel N*M to Pixel 1) and the X-axis can show the influence of an LED (for example LED 1 to LED L) on a pixel. Thus, a relationship between a pixel, for example pixel m 100 and an LED, for example LED k 102, may be shown. Here, in this exemplary figure, the dependence of pixel m 100 on any LED is shown as decreasing as the LED is located a greater distance from pixel m 100, or any other desired pixel. Accordingly, a matrix, for example matrix A, can be derived from a mathematical description of determining the backlight luminance of a pixel in an LED backlight at a particular location, as discussed in greater detail below. The luminance observed at the pixel's location can be determined to be the sum of the spread luminance intensities of combined LEDs in the backlight, as shown in the exemplary equation below where B is the backlight luminance as observed at a pixel (U) and L is the number of LEDs:

$$B(i, j) = \sum_{k=1}^{L} a_{ij}(k) \cdot x(k). \qquad \text{Equation 1}$$

The coefficients $a_{ij}(k)$ can model the spread of the light emitted from the k-th LED on its way to pixel (ij). As the LEDs can be driven by pulse width modulation (PWM), each LED may be driven to have a fixed luminance for a predetermined amount of time. For example, the duty cycle x(k) can lie between 0 and 100% and can determine the fraction of time when the k-th LED may shine with a fixed luminance. The power consumption can then be proportional to the sum of duty cycles. Thus, through a minimization of the sum of all of the PWM values, a minimization of power consumption may be realized, as shown below in Equation 2:

$$P \square \sum_{k=1}^{L} x(k) \qquad \text{Equation 2}$$

The boundary condition that the solution is desired to be clipping-free may then be described in a system of inequalities as shown in Equation 3:

$$\begin{bmatrix} A_{1,1} & A_{1,2} & \cdots & A_{1,L} \\ A_{2,1} & A_{2,2} & & \\ \cdots & & \cdots & \\ A_{N*M,1} & & & A_{N*M,L} \end{bmatrix} + \begin{bmatrix} x_1 \\ x_2 \\ \cdots \\ x_L \end{bmatrix} = \begin{bmatrix} B_1 \\ B_2 \\ \cdots \\ B_{N*M} \end{bmatrix} \geq \begin{bmatrix} r_1 \\ r_2 \\ \cdots \\ r_{N*M} \end{bmatrix}. \qquad \text{Equation 3}$$

Here matrix A can be made of $a_{ij}(k)$ and can capture the light spread model of the backlights and r represents exemplary gray values for a given image. However, when displaying an image or images, such as video, in high definition, the above system of inequalities can have more two million inequalities with more than one hundred variables of x. Therefore it may be difficult to determine an optimal solution that utilizes a minimal amount of power for this problem in real time, causing clipping, this may mean that at least one of the inequalities is not fulfilled, amongst other problems, in the resulting displayed image. Therefore, the present method, system and apparatus, in one exemplary embodiment, provide a faster approximation algorithm that can provide a nearly optimal solution assuring minimum power consumption.

Referring back to FIG. 1, a graphical representation of matrix A can be seen. In FIG. 1, the number of rows may be equivalent to the number of pixels and the number of columns may be equivalent to the number of LEDs. Thus, in this exemplary embodiment, the first column can describe the influence of LED 1 on the other pixels in the backlight. The first row may then describe the dependence of the first pixel on the LEDs. Thus, as can be seen from FIG. 1, matrix A can be viewed and manipulated as a sparse matrix because in some practical applications only a few LEDs may have a significant effect on a pixel where the influences of other LEDs on a pixel may be negligible or about negligible.

Figure 2:
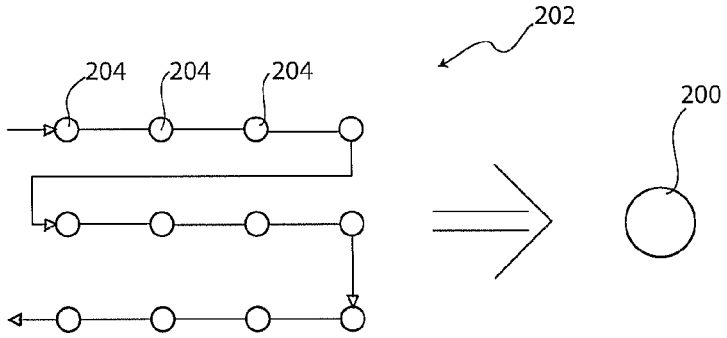
FIG. 2 is an exemplary diagram showing a block of diodes that may form an LED.

Referring now to FIG. 2, an exemplary diagram showing an LED 200 is shown. Here, the term LED may be used to describe a grid of diodes that are connected. As shown in FIG. 2, a 4×3 grid 202 of diodes 204 are shown. The diodes 204 may be connected in series and can be controlled with the same electrical signal so as to behavior in a substantially identical manner to act as LED 200. Further, any number of LEDs 200 may be used to form a backlight of any size, for example a backlight appropriately sized to correspond with a display. In still further exemplary embodiments, LEDs can be placed in any arbitrary or desired structure, for example, having edge lighting in a linear form, an L-shape, a U-shape, a rectangular shape or any other shape or form.

Figure 3:
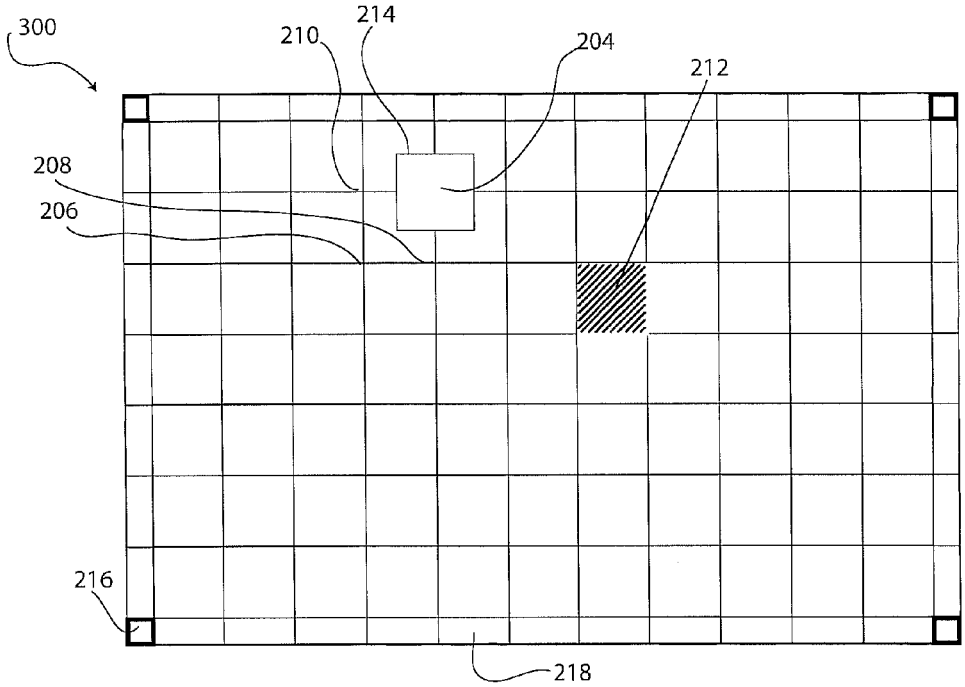
FIG. 3 is an exemplary figure showing pixels on a display and LEDs.

In exemplary FIG. 3, a display and some associated aspects regarding a backlight associated with a display 300 may be shown. The display 300 may be partitioned into any number of rectangles, for example rectangle 202. At any desired location, for example the corner of each rectangle, an LED, such as LED 204, may be situated. Additionally, LEDs that are adjacent to the same partition may form an LED group, such as the group formed by LEDs 204, 206, 208 and 210. Also, a pixel (not shown, but situated throughout display 300) may be associated with an LED that can have a dominant influence on the pixel. As shown in FIG. 1, each pixel may be influenced by one or more LEDs and the influence of an LED on a pixel may decrease as the distance from the LED to the pixel increases, as shown by influence rectangle 214 as associated with LED 204. Therefore, in some exemplary embodiments, a dominant LED may be an LED that is physically closest to a given pixel. Also, if two or more LEDs are determined to have substantially similar dominance over a pixel, one LED may be chosen over any other LED in any desired fashion, for example arbitrarily. Further, any pixels which share the same dominant LED may be said to form a cell of pixels or simply a cell. Additionally, each pixel can be assigned to an LED group, for example the pixels shown in the rectangle symbolizing LED group 212, the LED group typically having about 4 LEDs associated therewith. However, due to the borders and corners of the display, some LED groups may only have two LEDs associated therewith (for example, LED groups next to the border of a display such as pixels 218) or one LED associated therewith (for example, LED groups in the corner of a display such as pixels 216).

Figure 4:
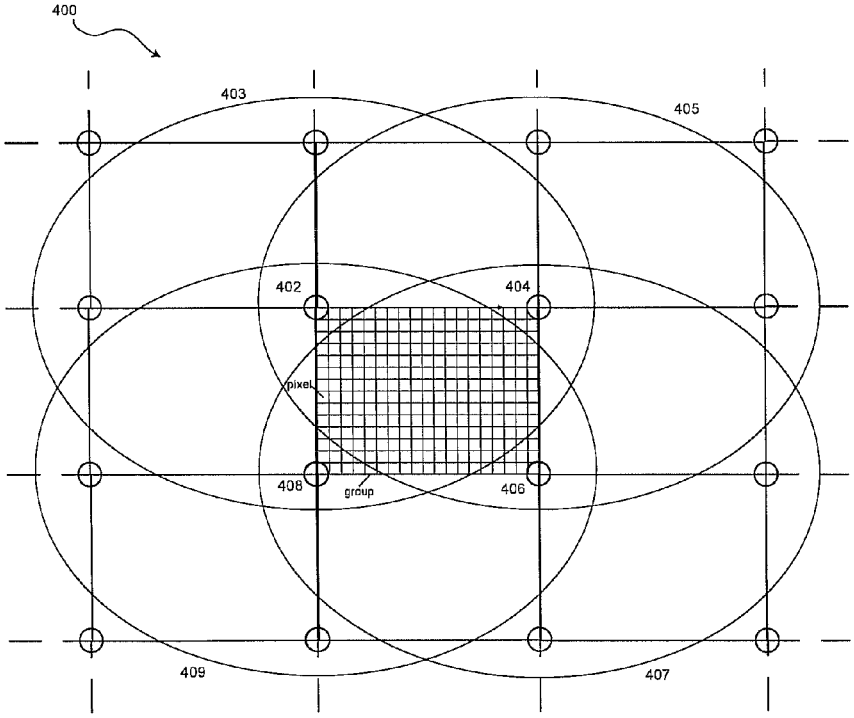
FIG. 4 is an exemplary figure showing an influence LEDs may exert on pixels.

Exemplary FIG. 4 provides further detail on the pixels and LED groups shown in FIG. 3, as a map 400 is made of LED groups that include four or more LEDs and where a pixel is influenced by four LEDs. However, as can be seen in FIG. 4, depending on the distance between LEDs, for example LEDs 402, 404, 406 and 408, and any diffuser characteristics of a display, more than four LEDs may influence a pixel. In this exemplary view, LED 402 may have an influence area of 403, LED 404 may have an influence area of 405, LED 406 may have an influence area of 407 and LED 408 may have an influence area of 409. After this information is gathered for a display, an algorithm for determining a desired brightness for an LED or LED group that will display an image or video in a desired manner may be formulated.

Still referring to FIG. 4, the influence of an LED group and its dominant LED on a pixel may be utilized in the formulation of the local dimming algorithm. For example, although matrix A in FIG. 1 can be described as a sparse matrix, the other elements of matrix A may not necessarily be defined as zero. However, smaller values in the matrix may be discounted or neglected so that the amount of LEDs that are considered to influence a pixel may be of limited size. In one example, the number of LEDs that may be considered to influence a pixel may be four, similar to the influence map shown on exemplary FIG. 4. Higher values or numbers of LEDs may be discounted or neglected as higher numbers of LEDs can facilitate the desire to utilize more expensive hardware, for example a processor having greater processing power than one that could be utilized in situations where more LEDs are neglected or discounted. Thus, determining an appropriate number of LEDs in a backlight whose brightness needs to be varied to provide a desired image may lead to both higher frame rates and higher quality displays.

Figure 5:
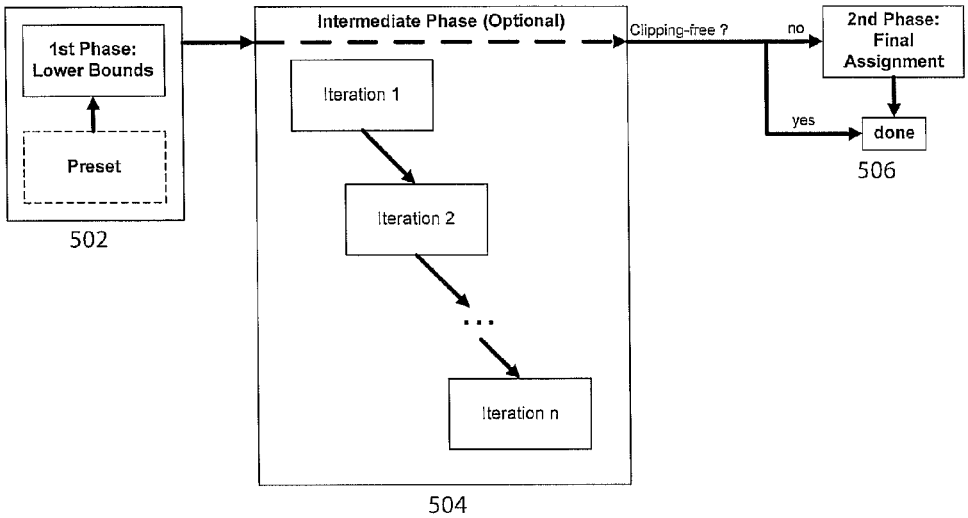
FIG. 5 is an exemplary chart showing phases of a local dimming algorithm

In one exemplary embodiment, and as shown in the exemplary chart of FIG. 5, an algorithm that may be used for a display may include a number of phases. In the first phase (phase 502) any pixels that make up an image may be inspected. As described previously, different pixels may be affected by different numbers of LEDs, for example one LED to four or more. Following the determination of the number of LEDs that affect a particular pixel, the gray value for that pixel may be correlated to the brightness's of LEDs through the use of an equation. For example, a pixel or a subpixel that is influenced by only one LED may have the brightness for this LED (k) set by the following equation:

$$x(k) \geq \frac{r_{ij}}{a_{ij}(k)}. \qquad \text{Equation 4}$$

Similarly, for pixels that may be influenced by two or more LEDs, the above equation may be modified. For example, for each LED that may dominate a pixel, an inequality may be derived by setting variable of other LEDs x(l) for l≠k to an image-independent predetermined value pre(l):

$$x(k) \geq \frac{r_{ij} - \sum_{l \neq k} a_{ij}(l) \cdot x(l)}{a_{ij}(k)}. \qquad \text{Equation 5}$$

In this exemplary embodiment, all of the LEDs x(l) except for the actual considered LED x(k) may be set to their predetermined values pre(l) and the result of their superposition may be subtracted to the pixel value. Further, for a lower computation effort using Equation 5, the LEDs of the LED group associated with the pixel may be taken into account where other LEDs may be discounted. Thus, the amount of processing needed may be significantly reduced.

The predetermined LED values pre(l) may be any value, for example upper bounds of a PWM duty cycle or an estimate thereof. In some exemplary embodiments where the upper bounds may be used as the predetermined values, the inequality of Equation 5 may yield lower bounds for the duty cycle values insofar as the duty cycles of the LEDs may be at least the lower respective bounds, which may further yield clipping-free image quality.

In further exemplary embodiments, a simple preset or predetermined value for LEDs x(l) that yields lower bounds may be a maximum duty cycle. Additionally, tighter upper bounds may be given by an optimum representation of an image, for example where an image to be displayed is significantly white. Thus, for an exemplary layout and light spread model, the summation of Equation 5 may be pre-calculated and stored in a memory, either externally by a computer, by the local dimming processor directly or in any other available manner. Thus, the summation of Equation 5, $\Sigma_{l \neq k} a_{ij}(l) \cdot pre(l)$, may be read from the memory and used for Equation 5 as a first phase (phase 502) for any or every image displayed on a display. Referring back to FIG. 3, because a display may be divided into any number of LED groups, processing and computing time may be conserved by computing and storing data for the LED groups. Further, the pixels may be processed in any order desired and the brightness of the LEDs may be updated in parallel. Any surplus of brightness in the LEDs may be accounted for by x(k). Thus, in this exemplary embodiment and during the first phase (phase 502) of FIG. 5, the all of the pixels in the display may be scanned and the pixels may be processed with respect to the LEDs groups to which they belong.

Using Equation 5 and using the assumption that the brightness of an LED may affect every pixel of an image, a value for a specific LED (e.g. x(k)) may be determined when the values of the other LEDs (e.g. x(l)) are set, as stated above with respect to Equation 5. Using this process, considering any pixel correlated to a LED (e.g. k-th LED), could yield a new x(k) according to Equation 5. The inequality can say that the LED value x(k) can be increased and the previous or "older" LED value can be overwritten by this new, higher LED value. Otherwise, if the "newer" LED value is lower than the "older" x(k), the older x(k) remains valid. Thus the pixels covered previously can remain covered as the new LED values that are determined can continue to be higher. Then previously covered pixels may not need to be reconsidered and, following a screening of every pixel, a complete phase can be completed.

Thus, using the above-described methodology and referring to an exemplary first phase (phase 502) of FIG. 5, an arbitrary order (or any desired order) for considering pixels may be used. In this example, only one LED value may be calculated while maintaining the values of other LEDs at a predetermined amount. Further, in the example where 100 LED values are to be determined, every calculation may be made where 99 of the LEDs are assigned a predetermined value in order to calculate the value of the other LED. This methodology may be used even when all but one of the LED values have been determined.

In a further exemplary embodiment, if the total number of pixels is too large and could result in a slower than desired processing speed, a smaller sample size may be used to determine the assignment of the first phase (phase 502). The use of a smaller sample size may allow for increased processing speeds and may not void any lower bound properties.

Further, during the first phase (phase 502), information may be collected, computed or otherwise gained that may be utilized in later phases, for example phases 504 and 506, as desired. For example, a factor by which the duty cycles may be multiplied to prevent clipping may be determined. Additionally, this additional information can be gained from an LED group or a single LED.

At the completion of phase one (phase 502), an assignment of LED brightness may be made to the desired LEDs. However, in some exemplary embodiments, some pixels may not be considered during phase one (phase 502), which may allow for an increased processing speed. Depending on the information gathered from any number of pixels that may have been considered, however, imperfections or undesired display effects may remain. However, as shown in the following exemplary embodiments, further processing or iterative phases may be utilized to achieve a desired image result. Additionally, any desired number of further iterative phases may be added which may allow smaller incremental increases in the LED values, while in the second phase (506) the LED values may be fully increased, as may be shown below. The addition of iterative phases can yield an increased power savings over fewer iterations. However, as the addition of further iterative phases may increase processing time, the number of iterative phases may be varied so as to provide for an ideal or desired power savings and processing speed.

In a second exemplary phase, phase 506, as shown in FIG. 5, and as further demonstrated by FIGS. 6A, 6B and 6C, the pixels may be divided and considered in any of a variety of manners. For example, the pixels may be considered in a predefined sequence as determined by their distance to their dominating LED and, correspondingly, can increase LED brightness so as to provide a desired influence on the pixel. One such sequence for considering pixels may be to start from each of the four corners of the LED group, as shown by the number "1" displayed in the four corners of the LED group of display 600 shown in FIGS. 6A-C, for example first pixel upper left, upper right, lower left, lower right, second pixel upper left, upper right, lower left, lower right, third pixel upper left, etc. Such an order processing the pixels assigned to an LED group can yield a power consumption very close to an optimum. The four described pixels can further be processed in parallel. The gray value of the pixel may then be satisfied according to the boundary condition of Equation 6:

$$x(k) \geq \frac{r_{ij} - \sum_{l \neq k} a_{ij}(l) \cdot x(l)}{a_{ij}(k)} \qquad \text{Equation 6}$$

Equation 6 differs from Equation 5 insofar as the actual assignment of x(l), which can be image-dependent, may now be used and, for the start, x(l) can be an output or assignment of the first phase (phase 502). Further, as the LEDs may be interdependent, each LED group may need to be considered as described previously, for example with regards to the assignment of the pixels to a LED group described previously. Following a screening of a complete image, the second phase (phase 506) may be completed.

As discussed previously, the luminance of a pixel can be affected by four or more LEDs. Therefore, to cover the gray value of a pixel, the LEDs that surround or influence a pixel may be varied or adjusted in brightness. Additionally, at the start of the second phase (phase 506), the intensities of the LEDs may be at their lower bounds but any underestimation of the final effect of the LEDs on surrounding pixels is minimized through the known decay of influence of LEDs on remotely located pixels, as discussed previously.

Also as discussed earlier, the $A_{m,k}$ of other LEDs may be set to zero to reduce complexity and processing time. However, in further exemplary embodiments where the brightness of an LED group may be calculated, the effect of other LEDs with a non-zero $A_{m,k}$ may also be considered. The brightness of these newly considered LEDs may not be updated, however as only the actual assignments can be used. Thus, the matrix of Equation 3 may still be considered a sparse matrix and the computation may be performed, as shown with respect to exemplary FIGS. 7A and 7B.

In exemplary FIGS. 7A and 7B, queues for processing LED groups, for example LED group 704 may start from corners and edges of the display 700 as these LEDs (for example LED 702) have the least amount of interdependency on other LEDs. Using this model, an LED group having a low or lowest interdependency with other LEDs may be determined. As many LEDs may belong to a number of LED groups, the brightness of an individual LED may be updated until it is not desired to be updated any more. As a result, a fixed assignment or value may be determined for an LED.

As shown in FIG. 7B, LED groups may be formed that are spatially disconnected at predetermined portions of the processing queue. The LEDs that may belong to the respective processing queue may then be disjoint. Therefore it may be possible to process the second phase (phase 506) in parallel. Therefore, parallel processing of the second phase (phase 506) may occur with the first or any earlier phases, such as phase 502 or intermediary phase(s) 504) if a single sequential processing is not occurring fast enough, for example for use with a video application that displays high resolution images at a high frame rate. As shown in exemplary FIG. 8, a display 800 may be partitioned in a variety of manners, for example allowing for fourth degree parallelization.

Figure 8:
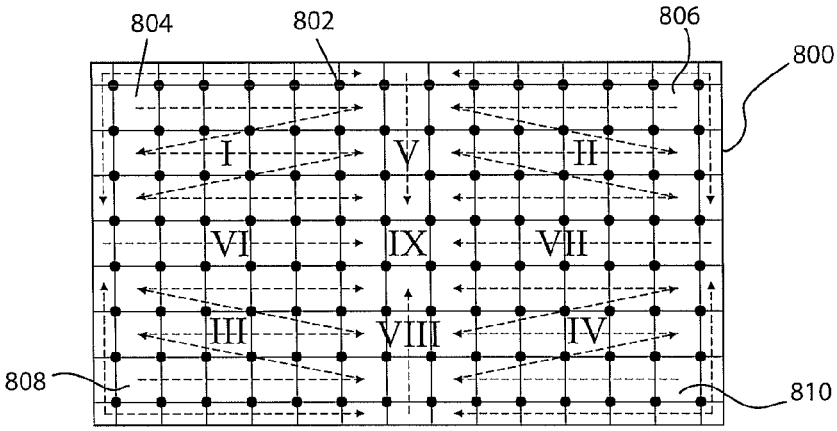
FIG. 8 is an exemplary diagram showing parallel processing of LEDs of a display.

In exemplary FIG. 8, sections I, II, III and IV of display 800 may be processed in parallel. As with previous examples, display 800 may include any number of LEDs and LED groups, for example LED group 802 and LED group 804. The lower bounds of the border area of the display may be sharp, which can correlate into an expected deviation between those lower bounds and final assignments as being small or negligible. Thus, if a calculation of the LED signals is started in the corners of the display 800, for example in LED groups 804, 806, 808 and 810, and moved along the edges, results approximating the optimum may be obtained. Further, if the parallel calculation of the first sectors is completed, sectors V, VI, VII and VIII may then be calculated in parallel, in a similar methodology as described above. Finally, sector IX maybe calculated. Due to the parallelization of the processing order, the time needed for processing may be significantly conserved.

Figure 6:
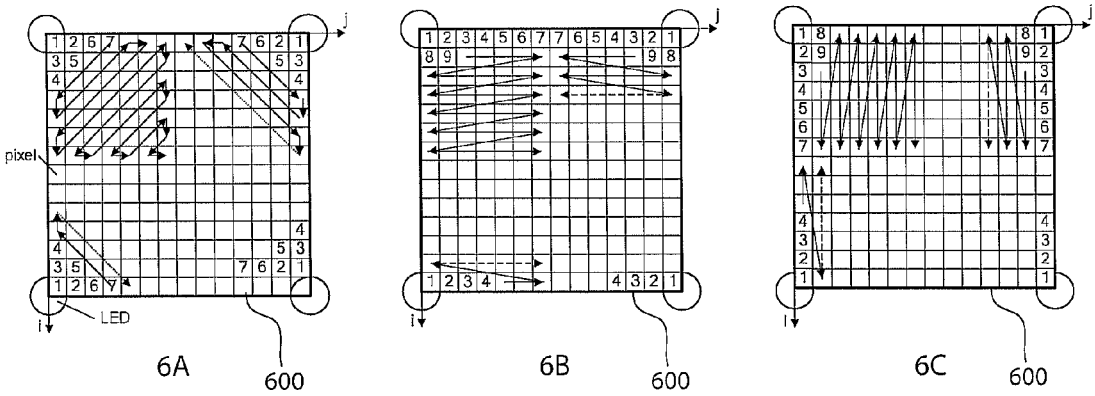
FIGS. 6A, 6B and 6C are exemplary diagrams showing sequences of pixel consideration.
Figure 7:
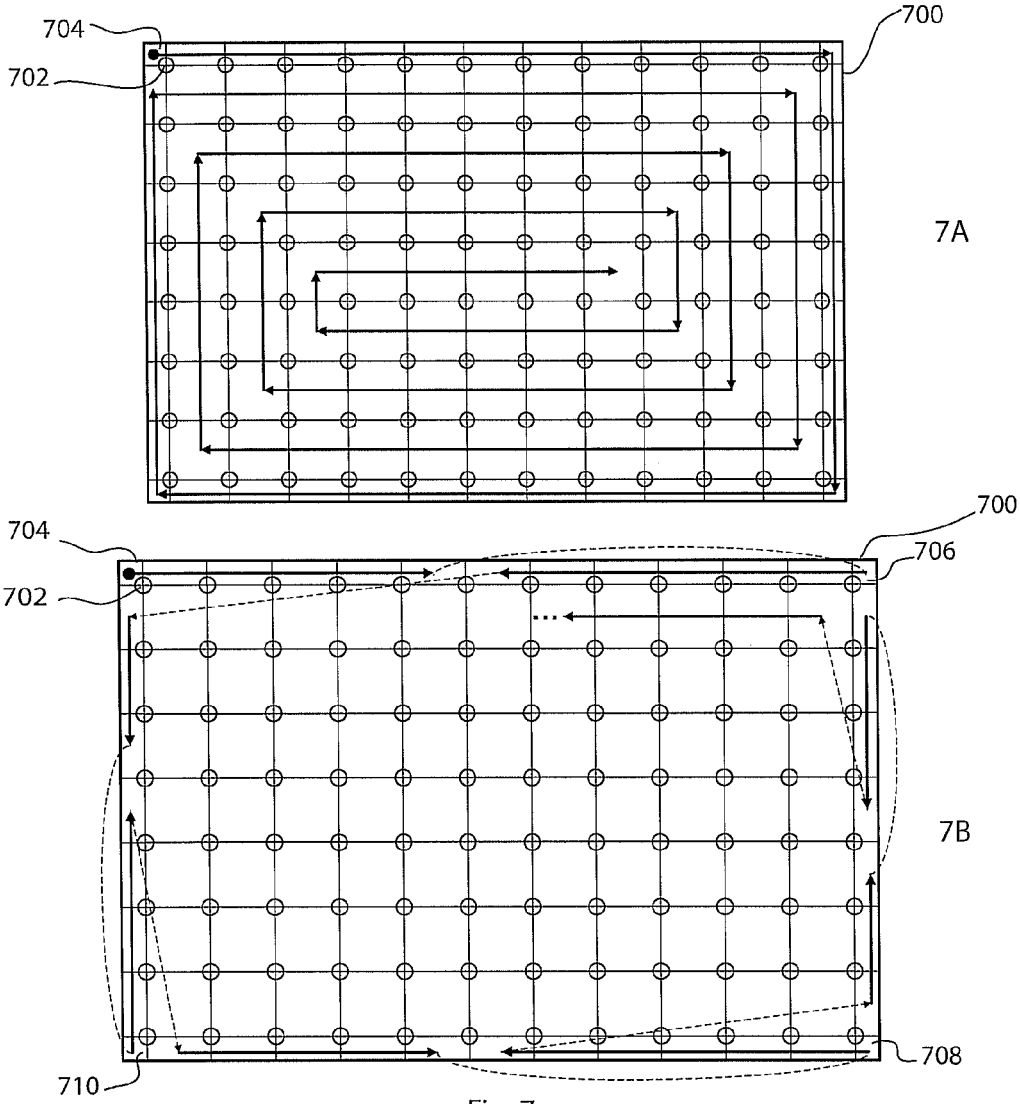
FIGS. 7A and 7B are exemplary diagrams showing processing sequences for LEDs.

The grouping of LEDs, for example a group of 4 LEDs, can employ the fact that, for many displays, the backlight can have many LED units, e.g. 100, and the light spread matrix may be sparse. The updating of LED brightness's one LED group at one time can yield a local optimization result which may be close to the result of the global optimization. However the computation effort of the processor may be much lower. For some displays, such as smaller displays and displays with edge light, the number of LED units may be much lower, for example 3, 6 or 10, and the light spread matrix may be not as sparse. Therefore grouping of a part of LED units may not reduce the computation effort considerably and the power consumption may still be considerably higher than the optimum. However the luminance of each pixel may remain dominated by its closest LED unit and this may be used for the global optimization. Thus the pixels can be considered in the same or similar sequence as illustrated by FIG. 6 whereby the closest pixels to the LED units can be considered first. The LED may also be sorted as the sequence shown in FIG. 7 whereby the LED unit with least interdependence to other LED units may be updated first and every LED value updated can be used to update the next LED. This global approach may yield a lower power consumption, for example a power consumption close to the optimum and the computation effort may be limited as the number of the LED units is limited.

In a further exemplary embodiment and referring to the intermediate phase (phase 504) of FIG. 5, one or more intermediate phases 504 may be performed between the first phase 502 and second phase 506 described above. In the one or more intermediate phases 504, a priority queue for any deficient pixels during the first phase 502 may be generated. The most deficient pixel may then have the brightness of the most dominant LED (p-th LED) increased by a predetermined percentage, for example 50%. If this process is repeated for each deficient pixel throughout the queue, the iterations of the process will realign the priority queue as the most deficient pixel changes. However, a number of iterations of this process may be predefined so as to avoid an unnecessary or undesirable number of iterations.

In some alternative embodiments, if an intermediate phase 504 iterates until there are no deficient pixels remaining, a final assignment for the brightness of the LEDs may be determined. As a result, the second phase 504 described above may be considered unnecessary. However, if deficient pixels remain after a predefined number of iterations of an intermediate phase 504 are performed, the second phase 506 may proceed as described previously. With either process, the brightness of the LEDs in the display may be determined to be at an optimal level and clipping-free boundary conditions may be established.

In further exemplary embodiments, an image may be condensed, for example prior to either a first phase (phase 502) and/or a second phase (phase 506). For example an array of about 20×15 pixels (or pixel values) may be condensed to one or more values. Such an array may be condensed by a variety of methods, for example by taking the average, median, maximum or any combination of values. In addition to this gray value for a new concentrated pixel, further values or numbers may be added to describe this concentrated pixel. For example, the condensing function that is used may depend on the content of the pixel array to be condensed. Also, the function may be coded as a number or value. Thus, a new image formed of the concentrated pixels with a lower pixel number may be presented. Then the light spread function can describe a relationship between the concentrated pixels and the brightness of the LEDs. The resultant processing and screen of a lower number of pixels may allow for the use of a simpler or lower cost processor while also increasing the processing speed of a display. Further, when desired, image enhancing techniques such as image enhancement and the like as well as further power saving techniques e.g. the reduction of the amplitude for high spatial frequency may be implemented when condensing pixels. Further, if the final LED values are known or available, the luminance of every original pixel may be determined or calculated as well as the transmission values of the LCD pixels and the calculation may also depend on the code for the condensing function and/or further values or numbers of the concentrated pixel corresponding to an LCD pixel.

In still another exemplary embodiment, an LED backlight may experience local dimming. In these examples, it may be desirable to determine the transmission values of the thin film transistor (TFT) pixels of the display. Using Equation 1, the luminance produced by any LEDs at a pixel location ij ($B_{ij}$) may be calculated. Then the TFT pixel values $t_{ij}$ may be calculated using Equation 7:

$$t_{ij} = \frac{r_{ij}}{B_{ij}} \qquad \text{Equation 7}$$

This calculation may, in some exemplary embodiments, be considered post-processing as the methodology described herein can efficiently calculate LED values as based upon the content of an image to be displayed. Also image enhancing techniques and/or further power saving techniques may be implemented in this post-processing phase. Additionally, the output of the post-processing can be stored in a memory and further can be used to control or drive the TFT pixels.

Figure 9:
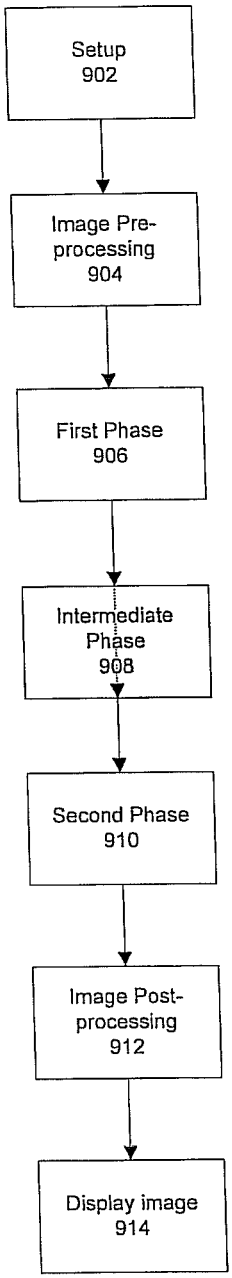
FIG. 9 is an exemplary flowchart showing steps of providing an image on a display.

In another exemplary embodiment, and as shown in the exemplary flowchart of FIG. 9, steps for the calculation of the brightness of a local dimming LED backlight may be shown. These steps may allow for increased performance of an LCD-type display and may support high resolution video applications using less complex and costly hardware. Additionally, power consumption for displays may be decreased.

Further, in step 902 the setup for the following calculations may be performed. The backlight board information e.g. the numbers and locations of the LEDs may be read, so that pixels may be assigned to an LED group and to their dominating LEDs. In addition, the light spread function of the LEDs and the predetermined LED values may be read and used to calculate the summation of Equation 5 $\Sigma_{l \neq k} a_{ij}(l) \cdot pre(l)$ values which may also be stored in a RAM. In step 902, a sequence of LED groups starting from a corner or edge of a display, along with a sequence of pixel starting from a proximate pixel to an LED and followed by more distant pixels may be designated. Additionally, it may be noted that any of the data involved with step 902 may be set, measured or calculated in a computer or by a processor that may be separate from a processor associated with a display. For example, this data can be stored in read-only memory (ROM) so that a processor associated with a display may not be utilized for such processing.

Still referring to FIG. 9, in step 904, the image data may be condensed and/or processed by using image enhancing and/or power saving techniques. Then in step 906, lower bounds from the first phase may be determined. Next, in step 908, a desired number of iterations may be performed to allow smaller incremental increases in the LED values while in the second phase of the algorithm (step 910) every pixel deficiency may be removed. Then, in step 912, an image may be post-processed so that the transmission value of every LCD pixel can be determined and used by the display driver, in step 914, an image may be displayed that is free of deficiencies, for example clipping, and the display on which it is displayed may have spent less time processing and conserved power over similar types of displays.

In still another exemplary embodiment, a grouping of LEDs, for example a group of 4 LEDs, can utilize a situation where, for many displays, the backlight can have any number of LED units, for example more or less than 100 LED units. Further, in such exemplary embodiments any light spread matrix may be sparse. An updating of LED brightness values one LED group at one time can yield a local optimization result which may be close to the result of the global optimization. However a computation or processing effort of a processor may be much lower. For some displays, such as smaller displays and displays with, having or utilizing edge light, the number of LED units may be much lower, for example 3, 6 or 10, and the light spread matrix may be not as sparse. Therefore grouping of a part of LED units may reduce a computation effort; but a power consumption level may still be higher than an optimum or higher than desired. However the luminance of each pixel may remain dominated by its closest LED unit and this may be used for a global optimization. Thus the pixels can be considered in the same or similar sequence as illustrated by exemplary FIG. 6, whereby the closest pixels to the LED units can be considered first. The LED may also be sorted as the sequence shown in exemplary FIG. 7 whereby the LED unit with a least amount of interdependence to other LED units may be updated first and, as desired, an LED value that is updated can be used to update a next LED or LED which may sequentially follow a prior LED. Such a global approach may yield a lower power consumption, for example, a power consumption close to an optimum or desired level and the computation or processing efforts may be limited as the number of the LED units can be limited.

Figure 10:
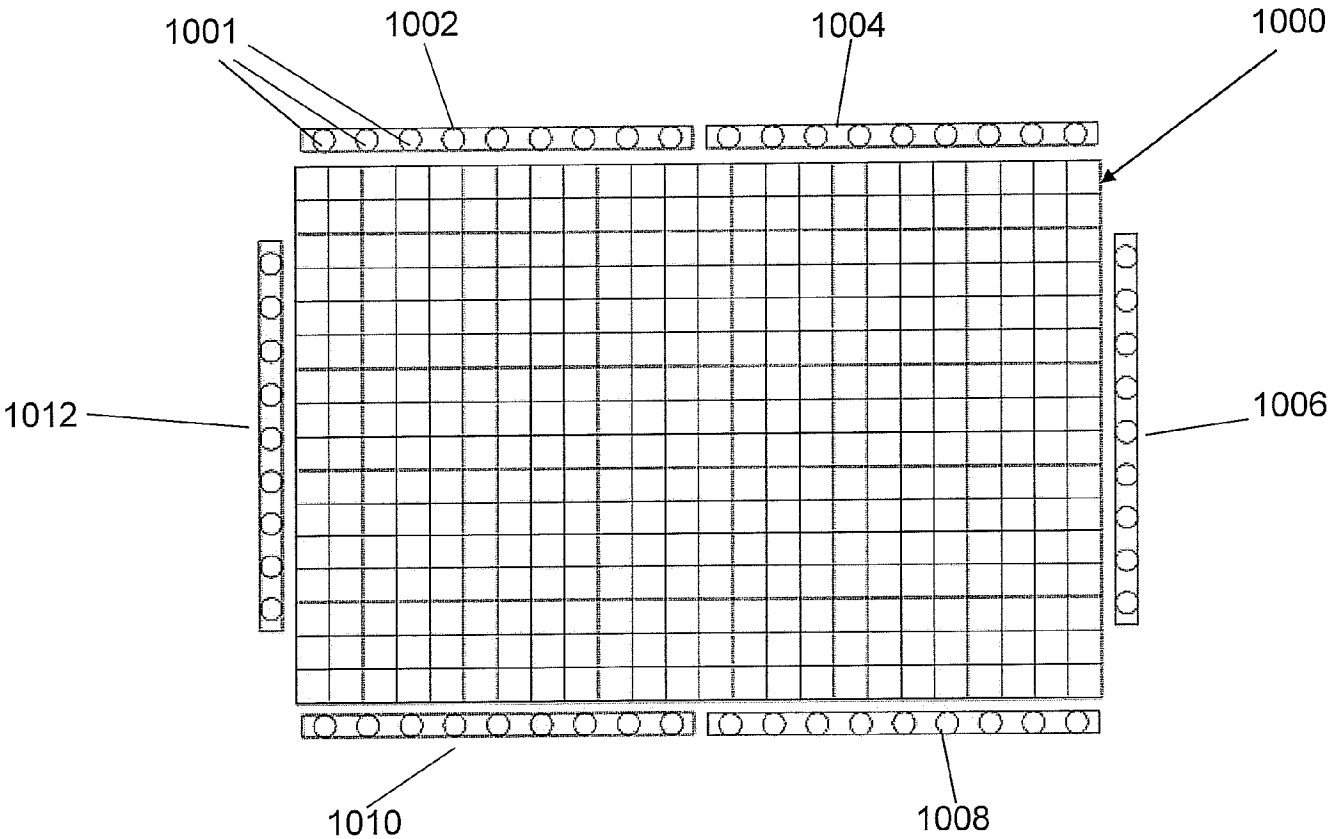
FIG. 10 is an exemplary diagram showing a display.

In a further exemplary embodiment, and as shown in exemplary FIG. 10, it may be shown how an optimization can be performed to consider a specific edge-lit or edge lighting construction. FIG. 10 may show a mechanical structure of an edge-lit LCD 1000 (or an LCD utilizing edge lighting). LEDs can be placed on at least one side and up to as many as sides as desired, for example four sides of a display, as shown in this exemplary figure. An LED string, for example LEDs strings 1002, 1004, 1006, 1008, 1010 and 1012, may have several light emitting diodes (LEDs), such as LEDs 1001, housed or included therein. A backlight may then be produced through the emission of light through any LEDs in LED strings 1002-1012 in a horizontal direction and then a deflection of the light to a vertical direction by a diffraction pattern.

Figure 11:
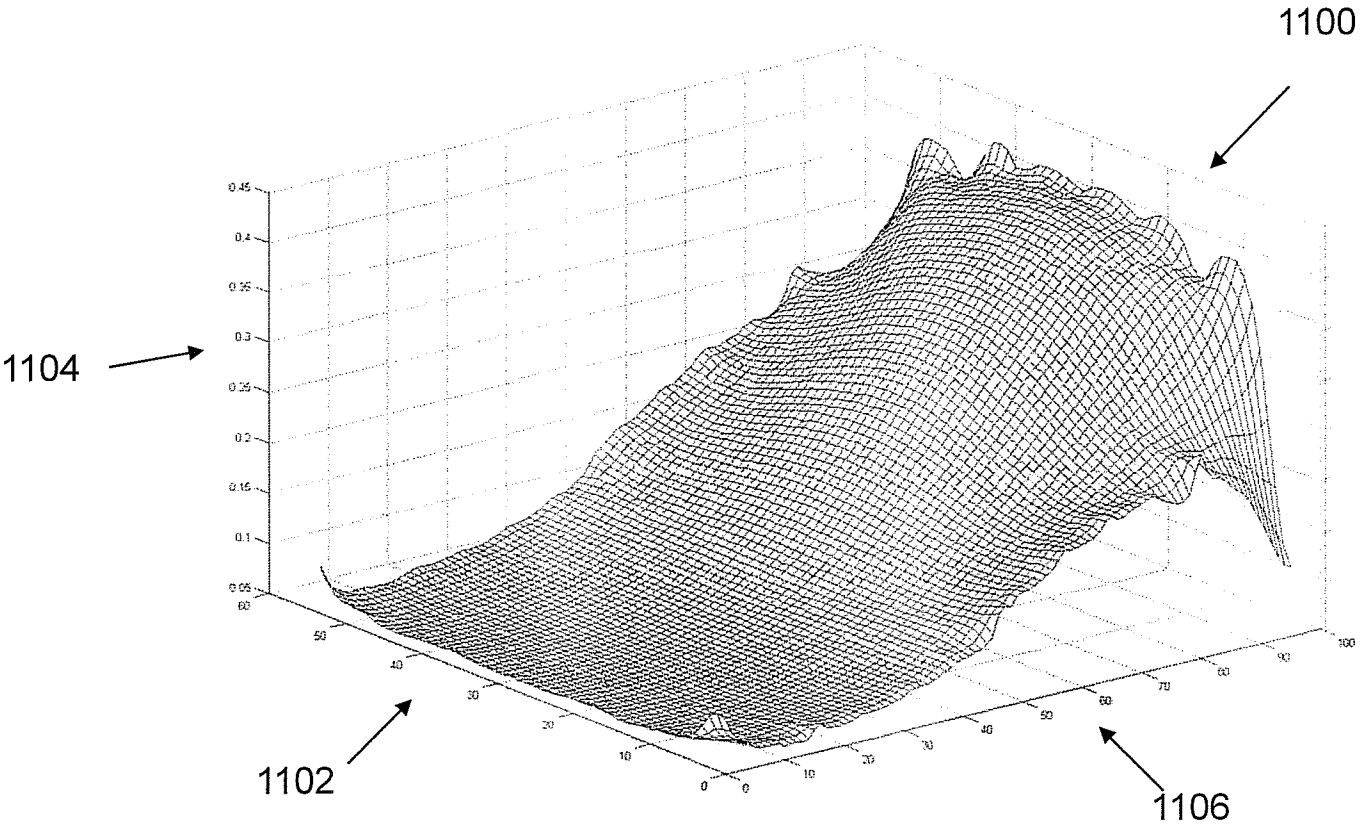
FIG. 11 is an exemplary graph of a light spread function of a display.

Further, according to this exemplary embodiment, a number of LEDs utilized on an edge-lit LCD may be much lower than that of a conventional direct-lit LED. The light generated by an LED, such as an LED in any of strings 1002 through 1012, may be distributed in a much larger area than an LED of a direct-lit LCD. In one example, a plot 1100 of the light spread function of LED string 1006 in the exemplary FIG. 10 over a full display of may be shown in exemplary FIG. 11. The x-axis 1102 may be the 1920 columns, the y-axis 1104 can be the 1080 row and the z-axis 1106 can be the light spread function in an arbitrary unit. From exemplary FIG. 11, it may be seen that the most pixels of the display are influenced by LED string 1006. The brightness behind a pixel can be provided by many LEDs emitting light. Thus, depending on the location of the pixel and the design of the diffraction pattern, a pixel may be dominated by an LED, a few LEDs or every LED may have a similar influence on a particular pixel. For example the contribution of every LED or the most LEDs for the brightness behind the pixels in the center of the display may be similar.

Further, in this example, the luminance can be contributed to by many LEDs. The relative influence of the k-LED at the pixel ij may be defined as:

$$RINF_{ij}(k) = \frac{a_{ij}(k)}{\sum_{p=1}^{s} a_{ij}(p)} \qquad \text{Equation 8}$$

where aij(p) may be the light spread function of the p-LED at the pixel ij, S may be the number of LEDs and the relative influence of each LED at a pixel can be between 0 and 100%.

Thus, in this example, depending on the position and the design of the diffraction pattern, the luminance behind a pixel may be primarily generated by one LED. Primarily, however, can mean that the influence of this LED is substantially higher than the second highest. In the present example, the pixel (ij) may be dominated by this LED or this pixel may be assigned to this LED.

Additionally, in some exemplary embodiments, the luminance behind a pixel may also be contributed to by several or even all LEDs with a similar influence. In this example, the pixel may be dominated by these LEDs or the pixel may be assigned to these LEDs. An influence queue for each pixel may be established so that LEDs are ordered for each pixel. Also, as described in more detail below, a dynamic adjustment of the influence queue may be utilized.

Further, a local optimization approach where the brightness of each LED can be changed more or less independently can yield a result which may deviate from an optimum. This can mean that the LED power levels may be higher than desired. Therefore, a simpler case may be considered where a pixel is dominated by a single LED. In order to cover a desired luminance by a pixel (ij) being considered, an increase of the brightness value of a dominating LED may be desired. However, the luminance at this pixel (ij) may also be substantially contributed by other LEDs which may be considered later. If the brightness of this LED is increased, the desired luminance of this considered pixel can be achieved, and the power consumption of this LED or these LEDs may be unnecessarily or undesirably high or the solution may be substantially away from an optimum.

Thus, in this exemplary embodiment, the interdependence of the LEDs may be considered and the intermediate phase as described above may be applied. The brightness values of the LEDs can be successively increased.

$$\Delta x(k) = \frac{\text{fraction} \cdot r_{ij} - \sum_{l=1}^{s} a_{ij}(l) \cdot x(l)}{a_{ij}(k)} \qquad \text{Equation 9}$$

$$\text{if } (\Delta x(k) > 0) x(k) = x(k) + \Delta x(k) \qquad \text{Equation 10}$$

Equations 9 and 10 can be the same as equation 6, if the parameter fraction is set to 1. Equation 9 states that LED brightness is just fractionally covered. For different zones or areas of a display, the fraction parameter may vary, for example the parameter may be increased from one iteration to a next iteration, whereas for the final iteration it may be one.

A luminance deficit at pixel (ij) may therefore be left. Further pixels can be subsequently considered which may be dominated by other LEDs. The brightness of other LEDs may be increased so that the luminance deficit at pixel (ij) is decreased. In the next iteration the increase of the LED brightness for pixel (ij) may therefore be lower.

If the brightness of one LED is desired to be increased over a maximum brightness, the brightness of this LED may be limited to a maximum value. Then the LED or LEDs with the second highest influence can be increased. Using the same logic, the next LEDs in the influence queue may be treated as the prior LEDs are at a maximum value. The influence queue may thus be dynamically ordered according to the influence of LEDs whose actual values are not at maximum during the iteration. The LEDs whose values are at maximum may then be deleted from the influence queue. Thus a generic definition of assignment of LED/LEDs to a pixel may be that this LED or these LED are at the first position of the influence queue.

Further, in this example, the consideration or reconsideration of a pixel can be interpreted mean to check if the luminance at this pixel produced by the LEDs with actual values is higher than the required fraction of the gray value of the image (for example if the right hand side of equation 9 is negative). If the luminance with actual LED values is too low (for example if the right hand side of equation 9 is positive), the brightness value of the LED at the first position of the influence queue may be increased.

In another exemplary embodiment, if a pixel is considered as dominated by several LEDs or if several LEDs are at the first position of the influence queue, an extension of Equation 9 above may be applied as shown in Equation 11.

$$\Delta x = \frac{\text{fraction} \cdot r_{ij} - \sum_{l=1}^{s} a_{ij}(l) \cdot x(l)}{\sum_{queue} a_{ij}(q)} \qquad \text{Equation 11}$$

In Equation 11, the brightness of the LEDs in the first position of the influence queue is updated according to Equation 12 below.

$$\text{if } (\Delta x > 0) x(q) = x(q) + \Delta x \qquad \text{Equation 12}$$

The denominator of Equation 11 can be the sum of light spread values of the LEDs in the first position of the influence queue. Equation 12 may be executed for every LED in the first position of the influence queue. x(q) stands therefore not just for one LED, but for several values of the several LEDs.

As in previous exemplary embodiments it may be possible that the brightness or brightness value of one LED or more LEDs may be desired to be increased over a maximum brightness. Thus, in such exemplary cases, the brightness of this or these LEDs can be set to a maximum and this LED or these LEDs may be deleted from the influence queue. If every LED at the first position of the influence queue has a maximum desired value, the LED or LEDs at the second position of the queue can be moved to the first position.

An iteration cycle may be scanning the display or a part of the display with the fraction parameter which may be different for the different zone. Scanning can mean the consideration of the pixels, every pixel of the display or a part of the display, and increase the LED brightness if desired according to equation 11 and 12.

The processing of pixels in such exemplary embodiments may be ordered in such a sequence that the regions with the highest relative influence can be treated first. Such a processing order may deliver a result which is closer to an optimum that an arbitrary processing order.

Figure 12:
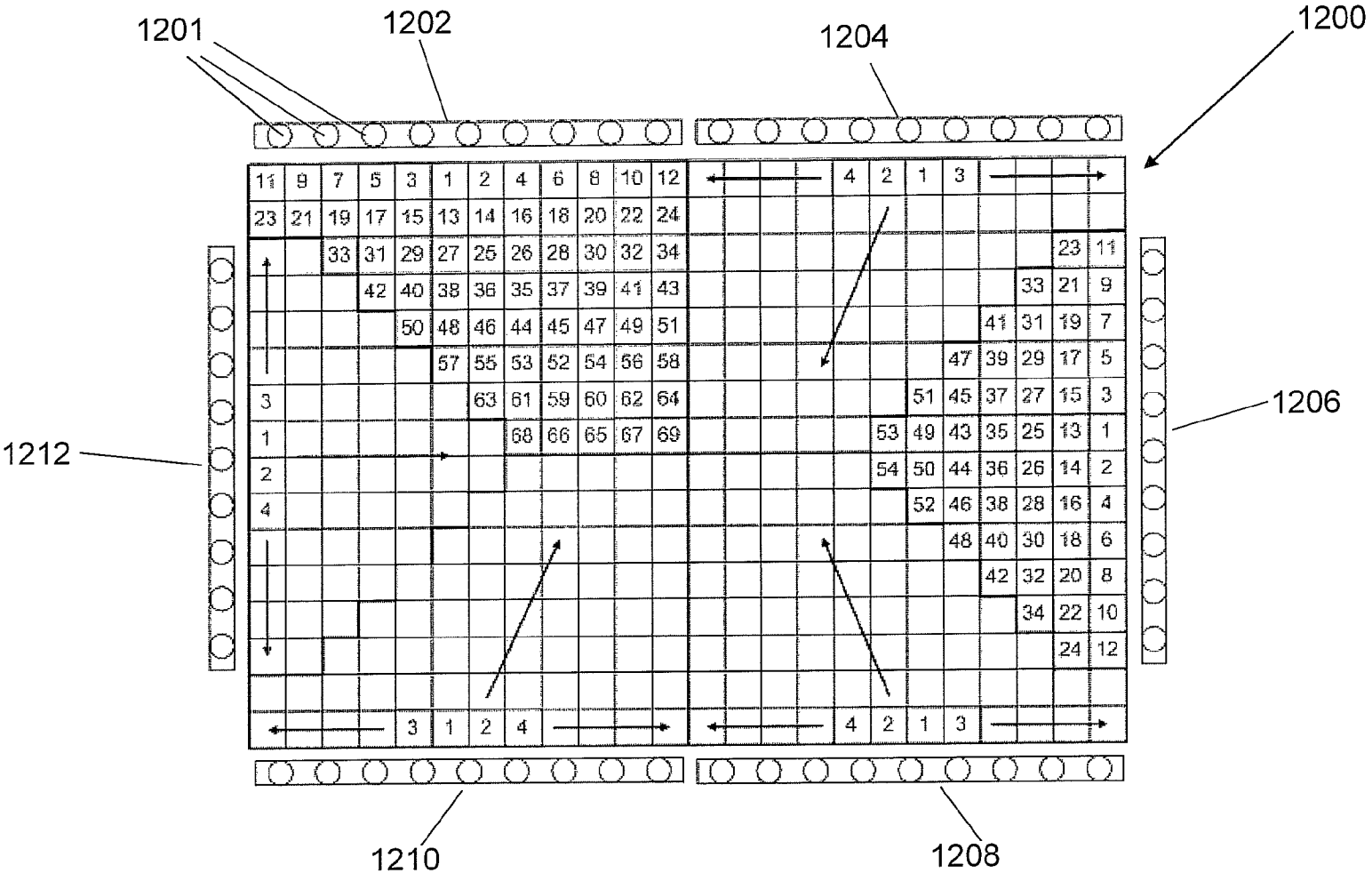
FIG. 12 is an exemplary diagram showing a processing order of a display.

As shown in exemplary FIG. 12, one exemplary processing order may be shown for a display 1200. In this example the processing order may be started from a border of display 1200. Thus the relative influence at the border, in particular in the center of an LED string, e.g. LED strings 1202, 1204, 1206, 1208, 1210 and 1212 (which may each include any number of LEDs 1201), may be the highest, as it may be normally dominated by this LED, while other LEDs may have little relative influence. Thus the current and/or power spent for this LED can be most efficient to cover the gray value of these pixels. Here the first pixels considered may be those on which the relative influence may be the highest. Relative influence instead of absolute influence may be considered for the processing order because the real light distribution over a display may be non-uniform.

In the exemplary embodiment shown in FIG. 12, in order to consider the exemplary interdependence of the many LEDs, the next pixel to be considered can be in a similar position but may be assigned to a different LED, for example a pixel towards a center of the border close to the LED and subsequently the pixels assigned to other LEDs. As shown in exemplary FIG. 12, the processing order can be defined as: pixel 1 of LED 1202, pixel 1 of LED 1204, . . . , pixel 1 of LED 1212; then pixel 2 of LED 1202 and so on. The order of LED 1202, LED 1204, . . . , LED 1212 may, however, be arbitrary. Alternatively, the order of LEDs may be defined by the maximum relative influence, in case the six respective maximum relative influences do substantially differ A second priority for the processing order can be from a border to the center of the display because the relative influence of one LED towards center may be getting lower. In the late phase of an iteration, the central region is scanned. At this time, the most LED brightness or brightness values may have been increased.

The sequence as shown in FIG. 12 can also be simplified or relaxed for a simpler processor design. For example, instead the order of 11, 9, 7, 5, 3, 1, 2, 4, 6, 8, 10, 12 for the pixels assigned to LED 1202, an order like 1, 2, 3, 4, 5, 6, 7, 8, 9, 10, 11, 12 may be used.

Additionally, in a further example, for lower processor complexity, HW cost and/or higher processing speed, only a part or portion of the pixels of the display may be considered for an iteration cycle. Which pixels are to be considered at which iteration cycle may change as a result of a variety of factors. For example for the first iteration cycle, pixels 11, 13, 15 etc. may be considered; for the second iteration cycle, pixels 12, 14, 16 etc. may be considered. The center region of display may even be not considered, if the pixels are influenced by all LEDs equally.

In order to achieve a processing speed and/or limit the cost of the processor, the number of iterations may be limited, as described previously. For the final iterations, every pixel or any desired number of pixels may be considered and the remaining deficit for each pixel may be compensated fully or the number for the fraction parameter in Equation 9 and/or Equation 11 is one. This may allow a clipping-free solution. This means that the constraint as described with respect to Equation 3 may hold.

The number of the iterations may be a trade-off between HW cost (complexity of the processor) and power saving. A very high number of iterations may not be desired, however, because the power saving will be saturated, while the HW cost increases and/or processing speed decreases.

Further, as described above with respect to equation 11 and 12, simple operations may be needed to calculate the optimum LED brightness values. With the parameter fraction, iterative steps and a processing order for pixels correlated to LED, the final solution may be very close to a global optimum, while the processing effort may be relatively low and just slightly higher than that of local optimization. The method may also be applicable for direct-lit or direct light LCDs.

A further exemplary embodiment may involve gradually decreasing the LED brightness. Starting from a maximum, predetermined LED brightness, the resulting backlight of a plurality of pixels may be calculated. The brightness of LED/LEDs assigned to pixels with a lowest surplus of backlight may then be gradually reduced. Such a decrease approach or a combined increase and decrease approach may also yield to a solution close to an optimum.

As modern displays and TVs have high resolution, the processing effort according to some exemplary method described above may be significant or high, as the number of pixels may be very high. For higher power saving produced by local dimming, a high number of independently controllable LEDs may be desired or advantageous, however this can further increase the processor complexity.

The condensing method described above may be combined to drastically reduce the HW cost. A rectangle structure consisting of w*z pixels can be condensed to one concentrated pixel which may also be correlated to the physical position on the display. Therefore the light spread function may easily be adapted as well as the influence queue. Since the light spread function of an edge-lit LCD is rather smooth, the display may be condensed even more coarsely. For example, 40*30 pixels may be condensed to one concentrated pixel, so that the number of pixels is reduced by a factor of 1200. Instead considering the original pixels, the concentrated pixels are scanned yielding much lower hardware cost and higher processing speed. The condensing function may include filter and/or image enhancing and/or power saving functions. The input data for the condensing function may be preprocessed by filter and/or image enhancing and/or power saving functions. Therefore a high optimization quality (high power saving) at low cost local dimming processor for the backlight of edge-lit as well as direct-lit LCD can be achieved.

The foregoing description and accompanying drawings illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A method of lighting a liquid crystal display, comprising:

calculating a luminance for a plurality of pixels in an image in a liquid crystal display (LCD) based upon a light spread function and a brightness value of light emitting diodes (LEDs);

changing the brightness value of one or more LEDs based upon a consideration of a gray value of the plurality of pixels and luminance generated by other LEDs;

performing iterative steps for changing the LED brightness values to successively cover a pixel gray value of the plurality of pixels; and setting the brightness value of the LEDs to a brightness value substantially greater than or equal to a gray value of a majority of the pixels of the image, and further comprising establishing an influence queue for each pixel in the plurality of pixels by considering the influences of the LEDs on each pixel in the plurality of pixels.

2. The method of claim 1, further comprising condensing the plurality of pixels into one pixel whose output is one or more values as a function of a gray value of the condensed pixels with a preprocessing unit.

3. The method of claim 1, further comprising filtering the image by preprocessing the plurality of pixels.

4. The method of claim 1, further comprising reducing a power consumption of the display by preprocessing the plurality of pixels.

5. The method of claim 1, wherein the backlight of the LCD is produced by one of edge light, direct light and a combination of edge light and direct light.

6. The method of claim 1, further comprising grouping a plurality of LEDs having a similar influence on at least one pixel in the plurality of pixels into one position in the influence queue.

7. The method of claim 1, wherein one or more LEDs in the plurality of LEDs at a first position of the influence queue are assigned to a pixel whose brightness is changed to at least partially cover a luminance of the pixel.

8. The method of claim 7, wherein the one or more LEDs in the plurality of LEDs assigned to a pixel and are updated if any brightness value of at least one or more of the LEDs in the plurality of LEDs is changed to a maximum value.

9. The method of claim 1, wherein the plurality of pixels are scanned in a sequence whereby a pixel in the plurality of pixels having an assigned LED with a higher relative influence is considered before a pixel in the plurality of pixels having an assigned LED with a lower relative influence.

10. The method of claim 1, wherein the plurality of pixels are scanned in a sequence whereby a pixel in the plurality of pixels having an assigned LED with a higher influence is considered before a pixel in the plurality of pixels having an assigned LED with a lower influence.

11. The method of claim 1, wherein each pixel in the plurality of pixels is considered in a sequence upon a distance of each pixel to the one or more LEDs.

12. The method of claim 1, wherein each pixel in the plurality of pixels are considered sequentially from at least one or more pixels assigned to a first LED to one or more pixels assigned to a second LED.

13. The method of claim 1, wherein a processing order of the plurality of pixels is predetermined.

14. The method of claim 1, wherein gray values for each of the plurality of pixels are successively covered.

15. The method of claim 1, wherein the LED brightness value is gradually increased.

16. The method of claim 1, wherein the LED brightness value is gradually decreased.

17. The method of claim 1, wherein the number of iterations in the performance of iterative steps for changing the LED brightness values to successively cover a pixel gray value of the plurality of pixels is limited.

18. The method of claim 1, wherein the plurality of pixels are one or more condensed pixels.

19. A liquid crystal display, comprising:

a plurality of pixels to display an image;

a backlight with a plurality of light emitting diodes (LEDs);

a processor that calculates a luminance for the plurality of pixels in an image in the liquid crystal display, changes a brightness of a light emitting diode based upon gray values of a number of the plurality of pixels and luminance generated by other LEDs, performs iterative steps to change LED brightness values to successively cover a pixel gray value of the plurality of pixels and sets the brightness value of the LEDs to a brightness value substantially greater than or equal to a gray value of a majority of the pixels of the image and an influence queue for each pixel in the plurality of pixels established through a consideration of the influences of the LEDs on each pixel in the plurality of pixels.

20. The display of claim 19, wherein the processor condenses the plurality of pixels into one pixel whose output is one or more values as a function of a gray value of the condensed pixels with a preprocessing unit.

21. The display of claim 19, wherein the plurality of pixels is one or more condensed pixels.

22. A system for providing an image on a liquid crystal display, comprising:

a plurality of pixels that display an image on a liquid crystal display (LCD);

a backlight having a plurality of light emitting diodes (LEDs) that light the image; and at least one processor that calculates a luminance for the plurality of pixels in the image on the LCD based upon a light spread function and a brightness value of the LEDs, changes the brightness value of the plurality of LEDs based upon a consideration of a gray value of the plurality of pixels and luminance generated by other LEDs, performs iterative steps for changing the LED brightness values to successively cover a pixel gray value of the plurality of pixels and sets the brightness value of the LEDs to a brightness value substantially greater than or equal to a gray value of a majority of the pixels of the image, wherein the processor further establishes an influence queue for each pixel in the plurality of pixels through a determination of the influences of the LEDs on each pixel in the plurality of pixels.

23. The system of claim 22, wherein the plurality of pixels is one or more condensed pixels.

* * * * *